US006457293B1

(12) United States Patent
Tsai

(10) Patent No.: US 6,457,293 B1
(45) Date of Patent: Oct. 1, 2002

(54) STEEL RIB PARTITIONING RACK

(76) Inventor: Ching Tsung Tsai, P.O. Box 2103, Taichung (TW)

( * ) Notice: Subject to any disclaimer, the term of this patent is extended or adjusted under 35 U.S.C. 154(b) by 0 days.

(21) Appl. No.: 09/669,163

(22) Filed: Sep. 25, 2000

(51) Int. Cl.[7] ..... E04L 3/30
(52) U.S. Cl. ..... 52/730.2; 52/731.9; 52/729.2
(58) Field of Search ..... 52/481.1, 482, 52/730.1, 730.2, 730.5, 730.6, 731.1, 731.2, 731.3, 634, 635, 690, 696, 670, 671

(56) References Cited

U.S. PATENT DOCUMENTS 5,519,978 A * 5/1996 Sucato et al. ..... 52/731.9
5,524,410 A * 6/1996 Menchetti ..... 52/729.2

* cited by examiner

*Primary Examiner*—Carl D. Friedman
*Assistant Examiner*—Steve M Varner

(57) ABSTRACT

Steel rib partitioning rack including two upright racks and multiple interconnecting sections extending between the two upright racks. Each interconnecting section has two interconnecting slats positioned side by side. The interconnecting slats are bent and respectively integrally extend from the interconnecting section toward the two upright racks. One end of each of the interconnecting slats of each interconnecting section is connected with the other, while the other ends of the two interconnecting slats are respectively connected with the two upright racks. When pulling and extending the two upright racks, the two interconnecting slats along with the upright racks are outward extended to contain different angles. Accordingly, the width of the partitioning rack is variable to form a necessary partitioning rack.

1 Claim, 7 Drawing Sheets

STEEL RIB PARTITIONING RACK

BACKGROUND OF THE INVENTION

The present invention relates to an improved steel rib partitioning rack. The width of the partitioning rack is variable according to the thickness of the wall so that the working procedure is simplified. In addition, the partitioning rack can be firmly bonded with the concrete.

FIG. 5 shows a conventional steel rib partitioning rack 7 which has a U-shaped cross-section. The partitioning rack 7 is formed with multiple slots 71 for reinforcements 81 to pass therethrough. Referring to FIG. 6, in working, the partitioning racks 7 are arranged at intervals and expansion meshes 82 are disposed on two sides thereof. The width of the partitioning rack 7 defines the thickness of the wall. Concrete is poured into the space between the two expansion meshes 82 to enclose and cover the partitioning racks 7. The concrete on two sides of the partitioning rack 7 are interconnected at the slots 71 of the partitioning rack 7 to form a steel rib concrete wall structure.

According to the above arrangement, the partitioning rack 7 only has slots 71 for the concrete to flow therethrough so that the flowability of the concrete is poor. Moreover, only the slots 71 permit the concrete on two sides to connect with each other, while the other parts are isolated by the partitioning rack 7. Therefore, the connecting area is apparently insufficient. The thermal expansion coefficients of the partitioning rack 7 and the concrete are quite different. As a result, under the effect of thermal expansion, a gap will be formed between the contact faces of the concrete and the partitioning rack 7 to lead to problem of leakage of water. Also, in case of earthquake, a fissure often is produced due to insufficient bonding force between the concrete on two sides of the partitioning rack 7. This will also result in leakage of water. Furthermore, the width of the partitioning rack 7 is designed in accordance with the thickness of the wall. Therefore, the wall with different thickness necessitates a partitioning rack 7 with different width. As a result, it is necessary to manufacture various sizes of partitioning racks 7. This leads to increased cost for molds and stock.

FIG. 7 shows another types of improved steel rib partitioning rack 9 which is formed by two rectangular steel tubes 91 and multiple bridge boards 92 welded therebetween. The steel tubes 91 and the bridge boards 92 are separately manufactured so that the cost for molds is lower. However, when assembled, it is necessary to weld the bridge boards 92 one by one between the steel tubes 91. Such procedure is laborious and time-consuming. Furthermore, the width of the partitioning rack 9 is still designed in accordance with the thickness of the wall. Therefore, it is still necessary to manufacture various sizes of partitioning racks 9. This still increases the cost for stock.

SUMMARY OF THE INVENTION

It is therefore a primary object of the present invention to provide an improved steel rib partitioning rack. When pulling and extending the upright racks of the partitioning rack to enlarge the distance therebetween, the interconnecting slats are pulled and outward stretched along with the upright racks to contain different angles. Therefore, the width of the partitioning rack is variable according to different thickness of the walls so that both the manufacturing and the working procedures are simplified.

It is a further object of the present invention to provide the above steel rib partitioning rack. The interconnecting section has a very small transverse interrupting area so that the flowability of the concrete is very good and the concrete and the partitioning rack can be firmly bonded together.

It is still a further object of the present invention to provide the above steel rib partitioning rack. The two upright racks of the partitioning rack are flexibly connected via the interconnecting section so that the entire partitioning rack has better flexibility.

The present invention can be best understood through the following description and accompanying drawings wherein:

DETAILED DESCRIPTION OF THE PREFERRED EMBODIMENTS

Please refer to FIGS. 1 to 4. The present invention is related to an improved steel rib partitioning rack. The partitioning rack has two upright racks 3 having predetermined cross-sectional shape. The two upright racks 3 axially extend in parallel to each other. Multiple interconnecting sections 2 integrally oppositely extend between the two upright racks. Each interconnecting section 2 has two interconnecting slats 21 positioned side by side. The interconnecting slats 21 are bent and respectively integrally extend from the interconnecting section 2 toward the upright racks 3. The opposite sides of the extending ends of the two interconnecting slats 21 are respectively connected with different sides of adjacent faces of the two upright racks 3. When the distance between the upright racks 3 is enlarged, the two interconnecting slats 21 of the interconnecting section 2 is stretched to enlarge the angle contained thereby as shown in FIGS. 3A to 3C.

Figure 1:
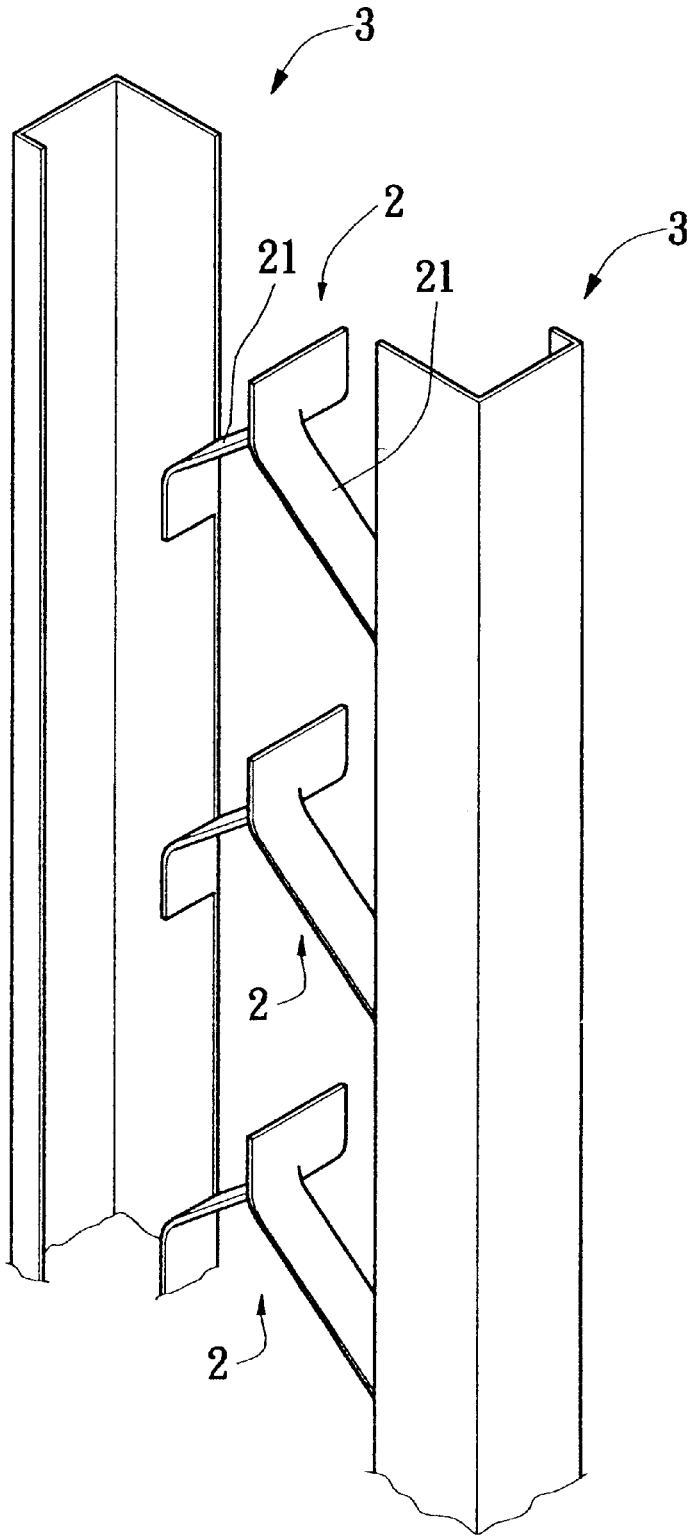
FIG. 1 is a perspective view of the present invention.
Figure 2:
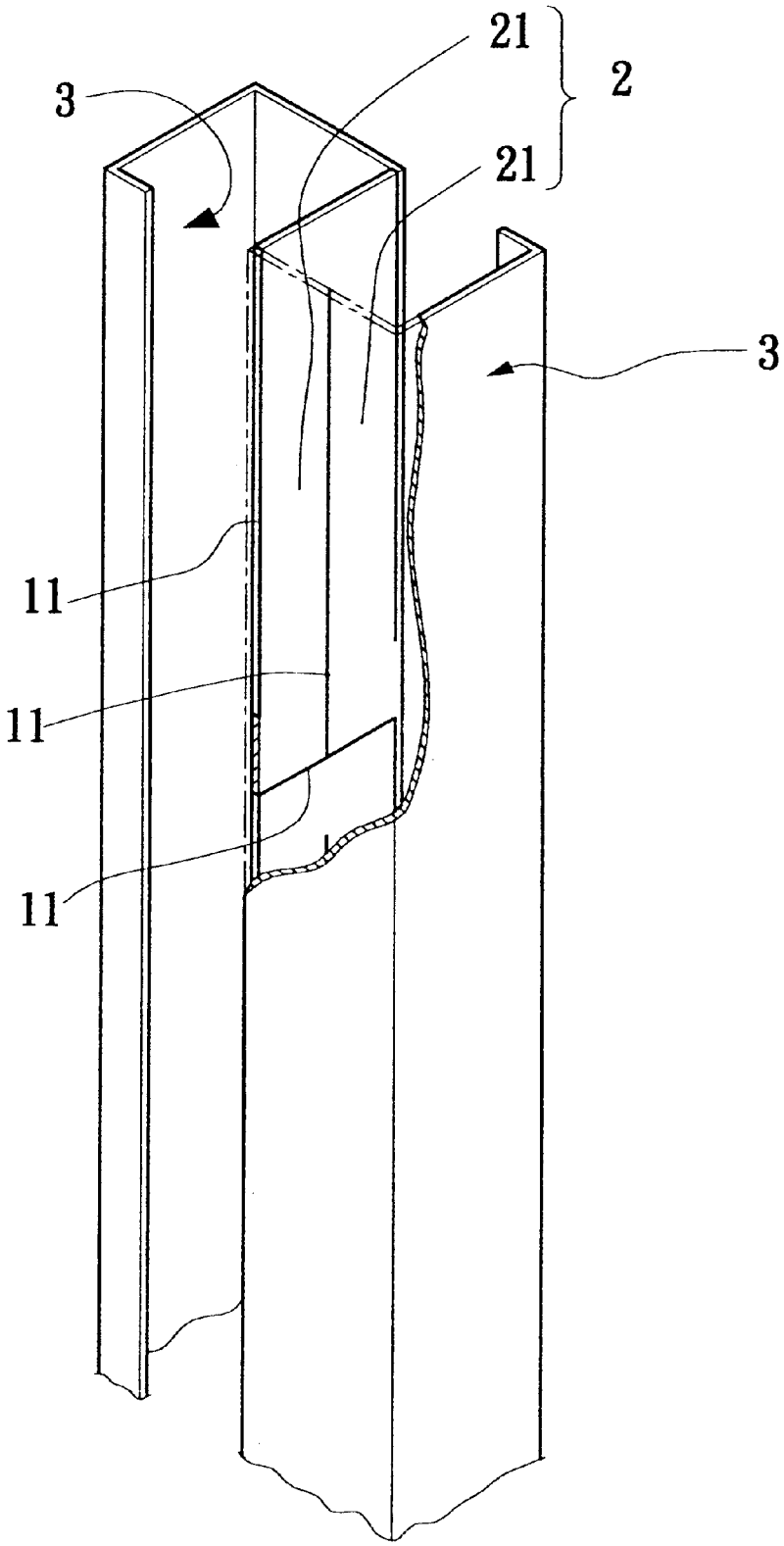
FIG. 2 is a perspective view of the partitioning rack of the present invention when bent and patterned.
Figure 3C:
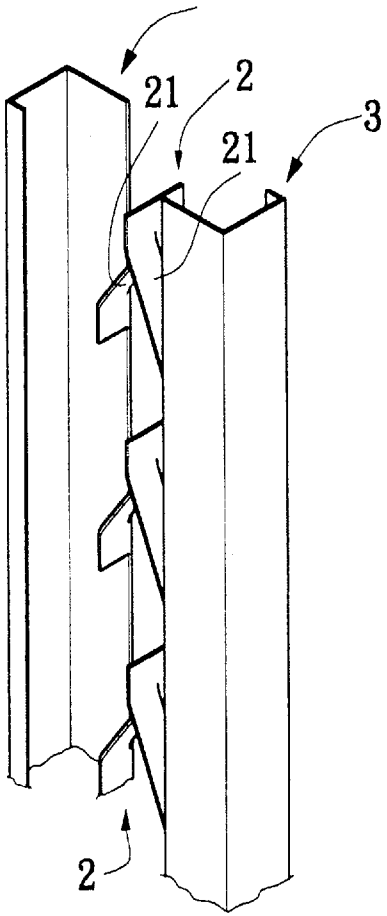
FIG. 3C is a perspective view of the partitioning rack of the present invention, which is pulled and extended into a narrower width.
Figure 3B:
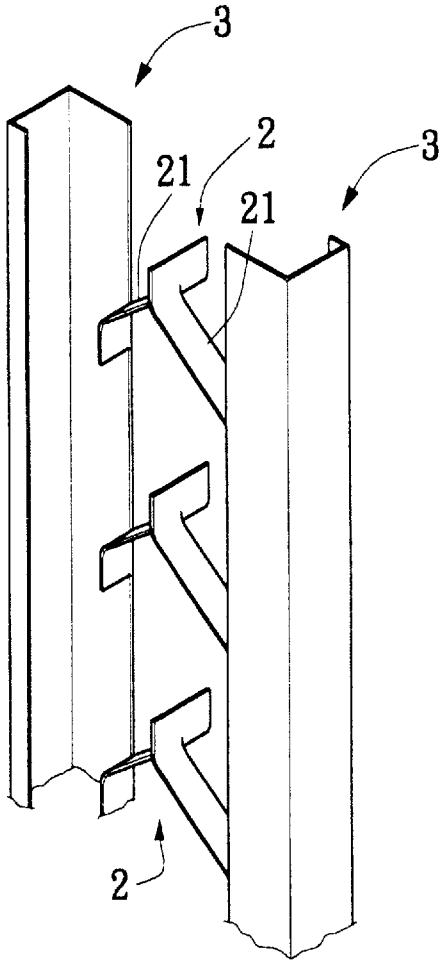
FIG. 3B is a perspective view of the partitioning rack of the present invention, which is pulled and extended into a middle width.
Figure 3A:
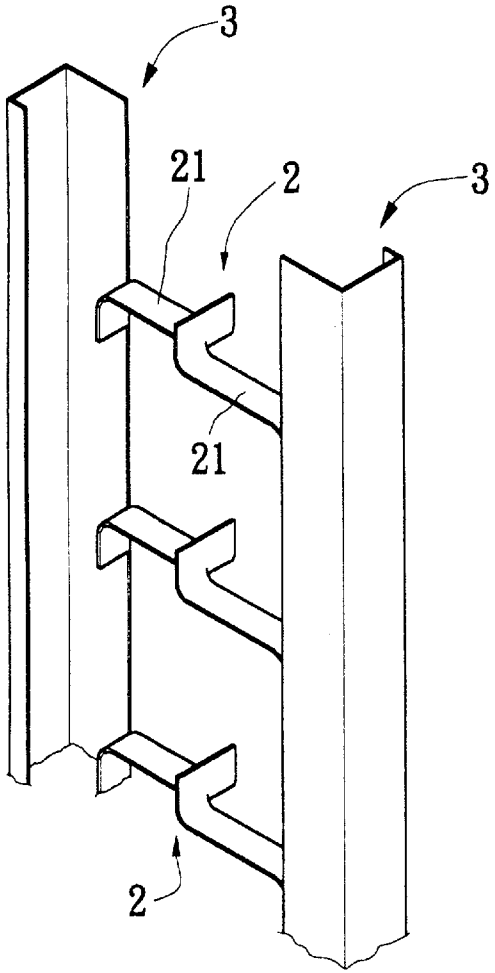
FIG. 3A is a perspective view of the partitioning rack of the present invention, which is pulled and extended into a large width.

In this embodiment, the two upright racks 3 and multiple interconnecting sections 2 are made by cutting an integral metal board to form slits 11 with predetermined shape. The metal board is then bent into a pattern as shown in FIG. 2. One end of each of the interconnecting slats 21 of each interconnecting section 2 is connected with the other, while the other ends of the two interconnecting slats 21 are respectively connected with the two upright racks 3. Therefore, when pulling and extending the two upright racks 3, the two interconnecting slats 21 along with the upright racks 3 are outward extended to contain different angles as shown in FIGS. 3A to 3C. Accordingly, the distance between the upright racks 3 is variable to form different widths of partitioning racks. This simplifies the manufacturing procedure for different sizes of partitioning racks and reduces the stock so that the cost is lowered. In a working site, it is no more necessary to prepare different sizes of partitioning racks and the same partitioning rack can be stretched and applied to different thickness of walls. This facilitates working.

Figure 4:
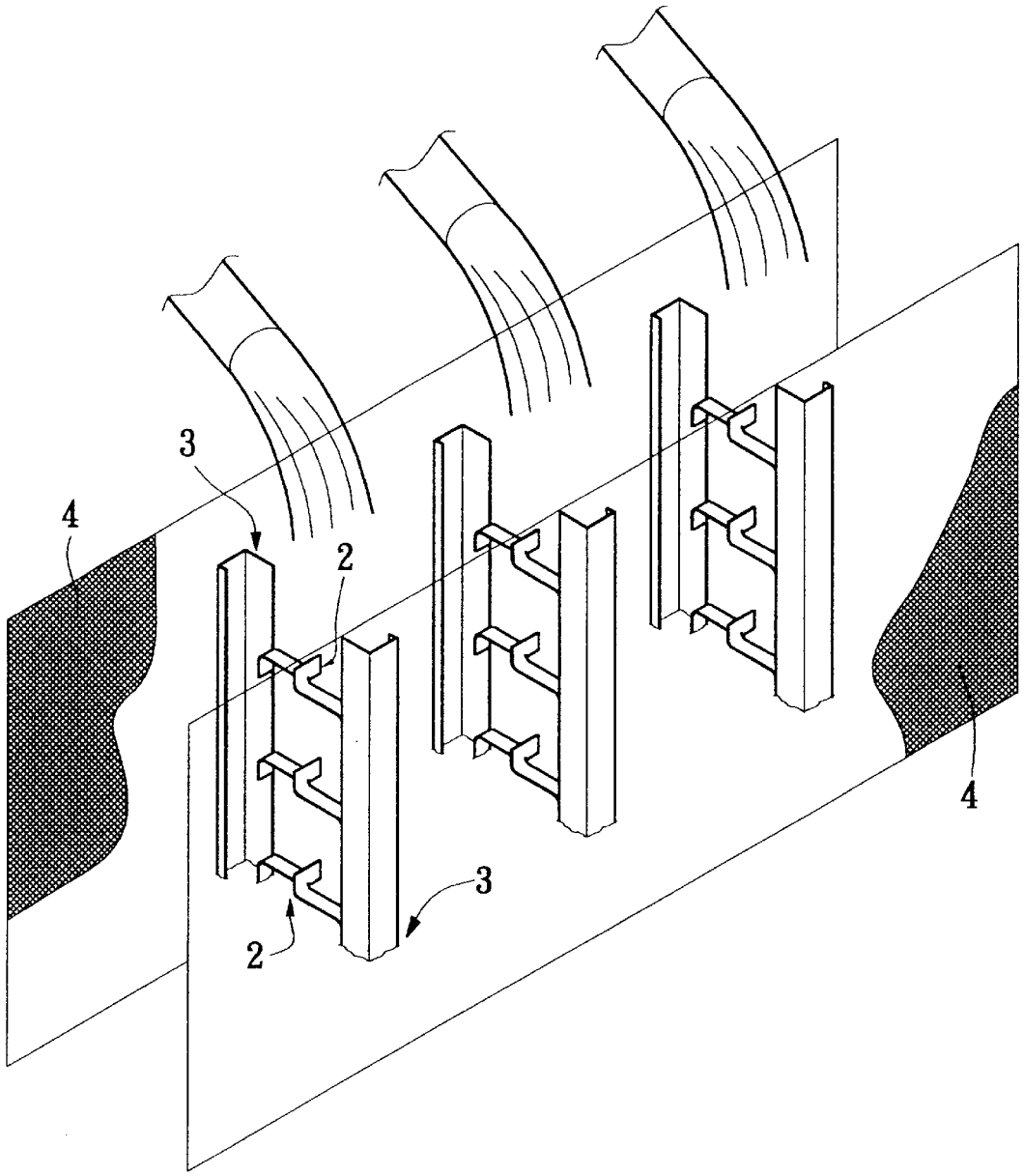
FIG. 4 is a perspective view of the partitioning rack of the present invention in working.
Figure 5:
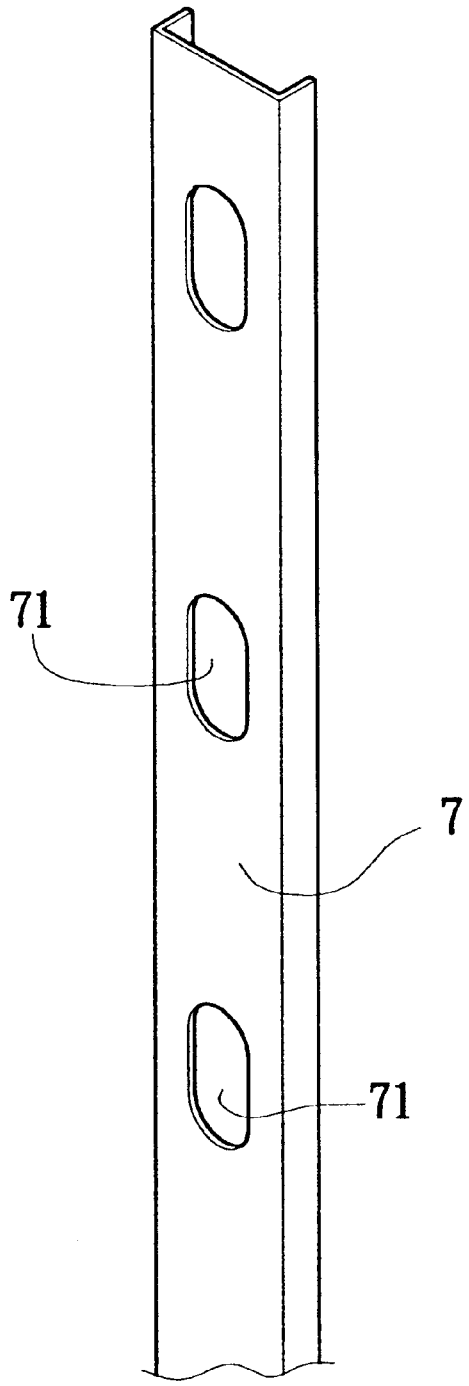
PRIOR ART FIG. 5
FIG. 5 is a perspective view of a conventional steel rib partitioning rack.
Figure 6:
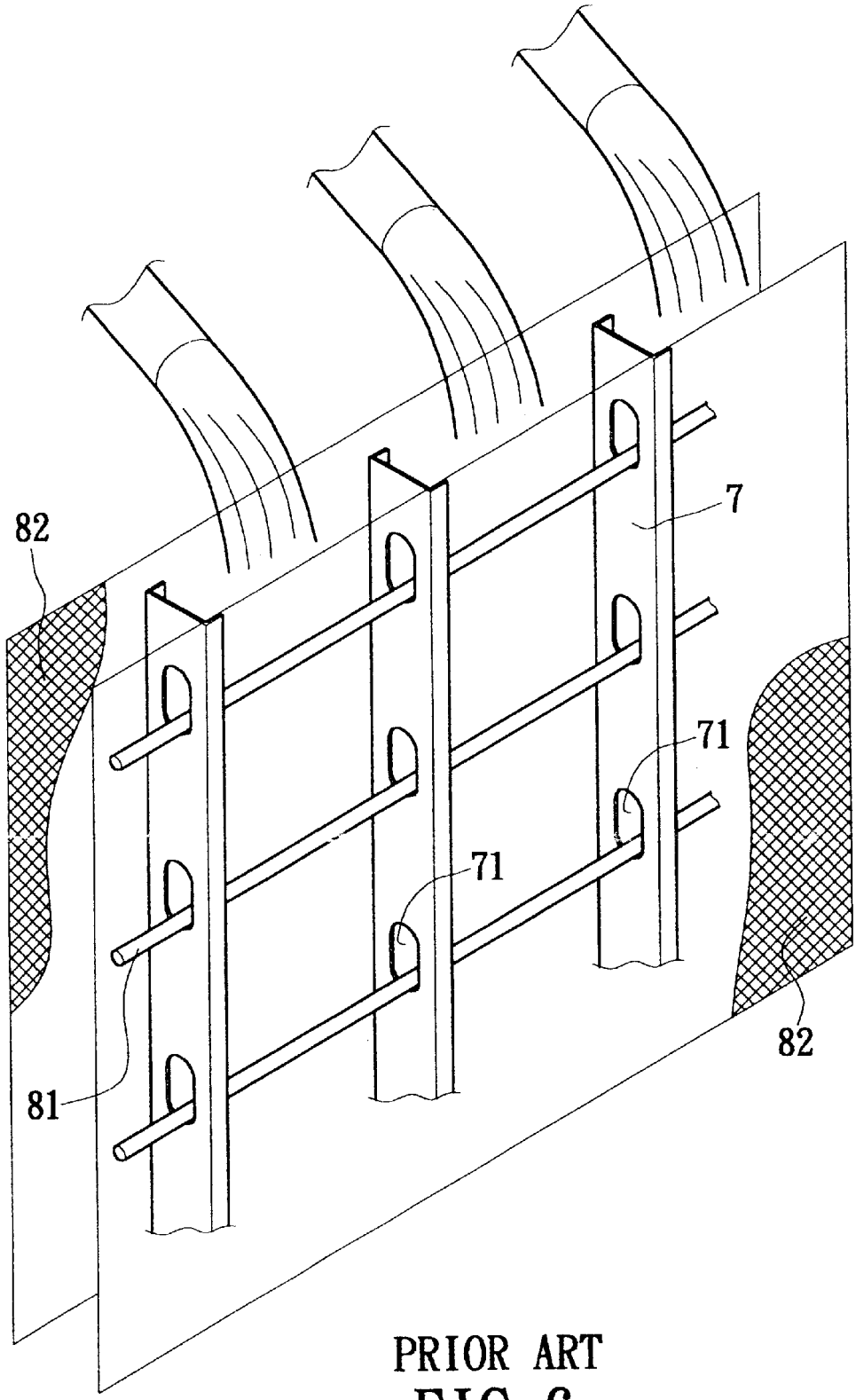
PRIOR ART FIG. 6
FIG. 6 is a perspective view of the conventional steel rib partitioning rack in working.
Figure 7:
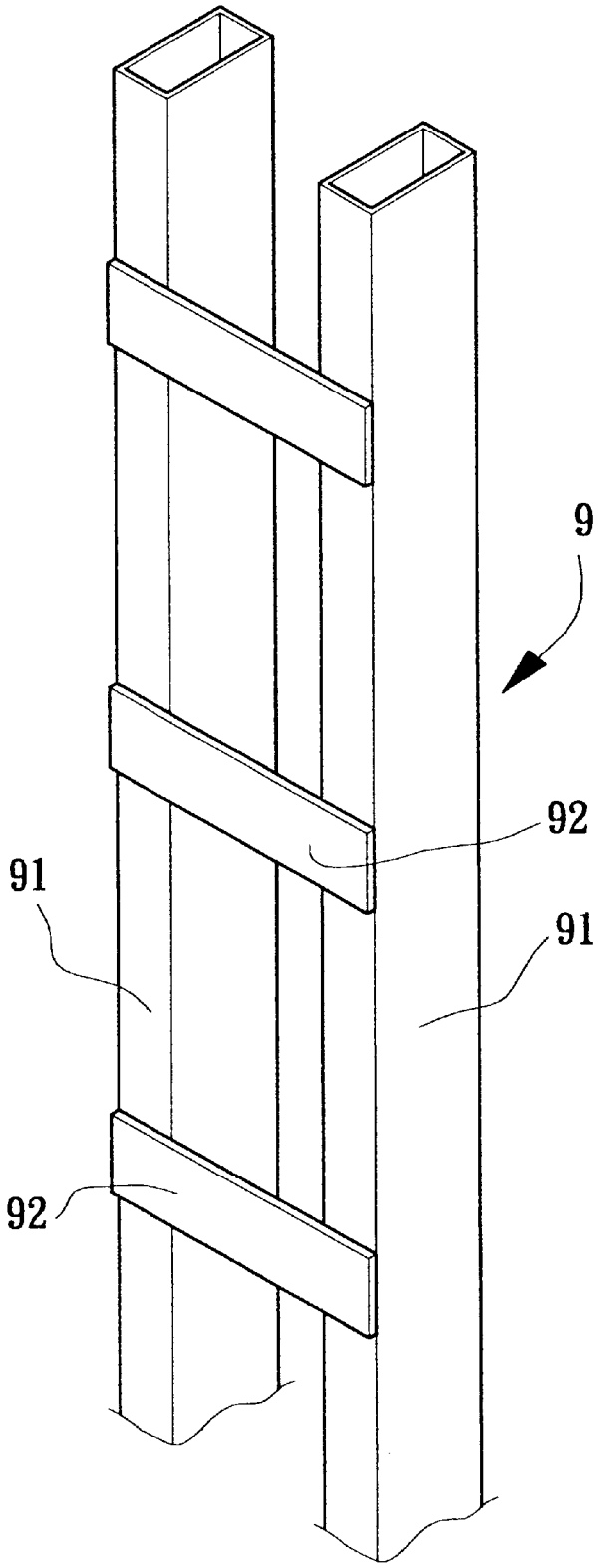
PRIOR ART FIG. 7
FIG. 7 is a perspective view of another type of conventional steel rib partitioning rack.

Please refer to FIG. 4 In working, the expansion meshes 4 are disposed on two sides of the partitioning racks and then grouting operation is performed. The interconnecting section 2 has a very small longitudinal sectional area so that the flowability of the concrete is very good. In addition, the concrete on two sides of the partitioning rack has considerably large connecting area so that the concrete and the partitioning rack can be firmly bonded together. Furthermore, the two upright racks 3 of the partitioning rack are flexibly connected via the interconnecting section 2 so that the entire partitioning rack has better flexibility. Therefore, when subject to thermal expansion/contraction or shake caused by earthquake, the partitioning rack can be properly deformed in cooperation with the deformation of the concrete. This improves the problem of water leakage due to fissure.

In conclusion, one end of each of the interconnecting slats 21 of each interconnecting section 2 is connected with the other, while the other ends of the two interconnecting slats 21 are respectively connected with the two upright racks 3. Therefore, when pulling and extending the two upright racks 3, the two interconnecting slats 21 along with the upright racks 3 are outward extended to contain different angles. Accordingly, the same partitioning rack has variable distance between the upright racks 3 so that the width of the partitioning rack is variable to meet the requirements for working on different thickness of walls. Therefore, both the manufacturing and working are facilitated. Also, the interconnecting section 2 has a very small longitudinal sectional area and the transverse interrupting area is very small so that the flowability of the concrete is very good and the concrete and the partitioning rack can be firmly bonded together.

The above embodiments are only used to illustrate the present invention, not intended to limit the scope thereof. Many modifications of the above embodiments can be made without departing from the spirit of the present Invention.

What is claimed is:

1. Steel rib partitioning rack comprising two upright racks having predetermined cross-sectional shape, the two upright racks axially extending in parallel to each other, multiple interconnecting sections integrally oppositely extending between the two upright racks, each interconnecting section having two interconnecting slats positioned side by side, the interconnecting slats being bent and respectively integrally extending from the interconnecting section toward the two upright racks, opposite sides of the extending ends of the two interconnecting slats being respectively connected with different sides of adjacent faces of the two upright racks.

* * * * *